US011891810B2

(12) United States Patent
Ma

(10) Patent No.: US 11,891,810 B2
(45) Date of Patent: Feb. 6, 2024

(54) AWNING APPARATUS

(71) Applicant: Zhun-An Ma, Ningbo (CN)

(72) Inventor: Zhun-An Ma, Ningbo (CN)

( * ) Notice: Subject to any disclaimer, the term of this patent is extended or adjusted under 35 U.S.C. 154(b) by 1044 days.

(21) Appl. No.: 16/213,895

(22) Filed: Dec. 7, 2018

(65) Prior Publication Data

US 2019/0177980 A1 Jun. 13, 2019

Related U.S. Application Data

(60) Provisional application No. 62/596,369, filed on Dec. 8, 2017.

(51) Int. Cl.
*E04H 15/06* (2006.01)
*E04F 10/06* (2006.01)

(52) U.S. Cl.
CPC ..... *E04F 10/0622* (2013.01); *E04F 10/064* (2013.01); *E04F 10/0637* (2013.01); *E04F 10/0688* (2013.01)

(58) Field of Classification Search
CPC . E04F 10/0622; E04F 10/0637; E04F 10/064; E04F 10/0651; E04H 15/06; E04H 15/08
See application file for complete search history.

(56) References Cited

U.S. PATENT DOCUMENTS 272,339 A 2/1883 Shuman
706,820 A 8/1902 Hansen
1,017,515 A 2/1912 Daus
1,095,452 A 5/1914 Clarke
1,389,002 A 8/1921 Turner
1,815,199 A 7/1931 Goldberg et al.
1,819,400 A 8/1931 Anton
1,823,649 A 9/1931 Goldberg et al.
1,824,188 A * 9/1931 Anton ..... E04F 10/0637 248/278.1
1,948,788 A 2/1934 Goldberg et al.
(Continued)

FOREIGN PATENT DOCUMENTS

AT 144587 2/1936
CH 625300 9/1981
(Continued)

OTHER PUBLICATIONS

Partial European Search Report in Application No. EP 09 25 1792, dated Nov. 3, 2011 in 7 pages.
(Continued)

*Primary Examiner* — Abe Massad
*Assistant Examiner* — Matthew R. Shepherd
(74) *Attorney, Agent, or Firm* — Knobbe, Martens, Olson & Bear, LLP

(57) ABSTRACT

An awning is provided that includes an extendable arm, a shelter member, and a joint. The extendable arm has an inner end coupled with a support and an outer end extendable away from the inner end. The shelter member has an outer portion coupled with the extendable arm support and disposed along the extendable arm. The joint has a mechanism responsive to an awning retraction force to raise outer portions of the extendable arms and an outer portion of the shelter member toward a horizontal orientation relative to a shade enhancing orientation.

12 Claims, 11 Drawing Sheets

(56) References Cited

U.S. PATENT DOCUMENTS 2,038,045 A 4/1936 Heiser
2,038,259 A 4/1936 Anton
2,144,827 A 1/1939 Anton
2,596,658 A 5/1952 Azzo
2,679,289 A 5/1954 Loos
2,740,470 A 4/1956 D'Azzo
2,823,885 A 2/1958 Azzo
2,880,956 A 4/1959 Beckstett
2,942,291 A 6/1960 Flint
3,188,035 A 6/1965 Owen
3,782,443 A 1/1974 Clauss et al.
3,923,074 A 12/1975 Mckee
3,991,805 A 11/1976 Clauss
4,077,416 A 3/1978 Lux
4,183,687 A 1/1980 Bramwell
4,214,621 A 7/1980 Wessels et al.
4,469,159 A 9/1984 Lohausen
4,479,526 A 10/1984 Rinaldi et al.
4,557,310 A 12/1985 Castelaw et al.
4,566,516 A 1/1986 Lohausen
4,590,642 A 5/1986 Hesener
4,673,017 A 6/1987 Lauzier
4,683,933 A 8/1987 Dunbar
4,784,204 A 11/1988 Lohausen
4,786,202 A 11/1988 Arnold et al.
4,953,609 A 9/1990 Annin et al.
5,029,363 A 7/1991 Hesener
5,119,867 A * 6/1992 Lukos ..... E04F 10/0618 160/70
5,133,397 A 7/1992 Lohausen
5,139,068 A 8/1992 Lohausen
5,232,036 A 8/1993 Brutsaert
5,265,373 A 11/1993 Vollebregt
5,273,095 A 12/1993 Lukos
5,307,856 A 5/1994 Murray
2,214,371 A 9/1994 Heiser
5,365,989 A 11/1994 Bodentien et al.
5,394,921 A 3/1995 Lohausen
5,752,556 A 5/1998 Steadman
5,836,210 A 11/1998 Lohausen
5,924,466 A 7/1999 Kroner et al.
6,024,152 A 2/2000 Rosenich
6,024,153 A 2/2000 Goldman
6,032,909 A 3/2000 Kroner
6,216,762 B1 4/2001 Lin
6,484,069 B2 11/2002 Osinga
6,598,612 B1 7/2003 Crowe
6,637,717 B2 10/2003 Li
6,732,018 B2 5/2004 Osinga
6,739,371 B2 5/2004 Mukai
6,763,874 B1 7/2004 Chen
6,796,356 B2 9/2004 Kirby
6,796,357 B2 9/2004 Kirby
6,820,673 B2 11/2004 Wessels
6,874,558 B2 4/2005 Mester
6,874,559 B1 4/2005 Hicks
6,904,826 B2 * 6/2005 Hesener ..... E04F 10/0637 160/79
7,017,976 B1 3/2006 Rutherfors et al.
7,117,565 B2 10/2006 Brutsaert
7,163,042 B2 1/2007 Li
7,179,009 B2 2/2007 Stimpfl et al.
7,353,855 B2 4/2008 Collishaw
D568,662 S 5/2008 Bohlen
7,367,376 B2 5/2008 Forns
7,371,180 B2 5/2008 Cymbal et al.
7,451,797 B2 11/2008 Forns
7,520,091 B2 4/2009 Friedman
7,628,194 B2 12/2009 Wagner et al.
7,645,088 B2 1/2010 Voss
7,740,044 B2 6/2010 Gutierrez
7,753,612 B2 7/2010 Bouru et al.
7,789,122 B2 9/2010 Ito
D633,976 S 3/2011 Corradi et al.
8,042,596 B2 10/2011 Forns
8,113,260 B2 2/2012 Forns
8,141,613 B2 3/2012 Brutsaert
8,205,656 B2 6/2012 Ma
8,316,910 B2 11/2012 Popa et al.
8,336,947 B2 12/2012 Chenowth
8,347,935 B2 1/2013 Svirsky et al.
8,469,078 B2 6/2013 Drew
8,661,575 B2 3/2014 Chapus
8,726,967 B2 5/2014 Forns
8,800,214 B2 8/2014 Silberman et al.
8,807,513 B2 8/2014 Volin
9,038,648 B1 5/2015 Xie
9,228,358 B2 1/2016 Homung
9,249,610 B2 2/2016 Reus
9,353,529 B2 5/2016 Richmeier
9,469,996 B2 10/2016 Ma
9,469,997 B2 10/2016 Thompson
9,644,374 B2 5/2017 Ivic
9,644,389 B2 5/2017 Xie
9,831,366 B1 11/2017 Stribling et al.
9,915,062 B2 3/2018 Forsland et al.
9,938,723 B2 4/2018 Shargani
10,006,206 B2 6/2018 Traub
10,066,414 B2 9/2018 Ma
10,094,122 B1 10/2018 Akbulut
10,280,625 B2 5/2019 Byszenski et al.
10,385,574 B2 8/2019 Thompson et al.
10,428,549 B2 10/2019 Ma
10,494,817 B2 12/2019 Bailey et al.
10,560,050 B2 2/2020 Raghunathan
10,604,940 B2 3/2020 Westgarth
10,689,848 B2 6/2020 Castel
10,954,689 B2 3/2021 Ma
11,613,894 B2 3/2023 Ma
2001/0027846 A1 10/2001 Osinga
2002/0014315 A1 2/2002 Toffey
2003/0000154 A1 1/2003 Ignazio
2004/0016511 A1 1/2004 Mester
2006/0108819 A1 5/2006 Wagner et al.
2006/0201635 A1 9/2006 Ridley et al.
2007/0051476 A1 3/2007 Forns
2007/0193700 A1 8/2007 Ornelas et al.
2007/0199662 A1 8/2007 Miller
2007/0246168 A1 10/2007 Ito
2008/0053624 A1 3/2008 Ito
2008/0135145 A1 6/2008 Hsieh et al.
2008/0277073 A1 11/2008 Ito
2009/0025887 A1 1/2009 Ito
2009/0050277 A1 2/2009 Ito
2010/0032106 A1 * 2/2010 Ma ..... E04F 10/0637 160/22
2012/0134611 A1 5/2012 Voss
2012/0273144 A1 11/2012 Forns
2013/0118696 A1 5/2013 Gavish
2013/0126104 A1 5/2013 Weber
2013/0149023 A1 6/2013 Wiecko
2014/0251552 A1 9/2014 Ma
2017/0025990 A1 1/2017 Mastrogiannis
2017/0284122 A1 10/2017 Ma
2017/0321427 A1 11/2017 Thompson et al.
2018/0102734 A1 4/2018 Katz
2018/0106046 A1 4/2018 Castel
2018/0320381 A1 11/2018 Ma
2018/0363366 A1 12/2018 Ammerlaan et al.
2019/0112832 A1 4/2019 Larin et al.
2019/0145107 A1 5/2019 Byszenski et al.
2019/0323232 A1 10/2019 Mitchell
2019/0330837 A1 10/2019 Nicholas
2019/0368201 A1 12/2019 Thompson et al.
2020/0087912 A1 3/2020 Konings
2020/0308841 A1 10/2020 Bliss et al.
2020/0354962 A1 11/2020 Whytlaw
2022/0136253 A1 5/2022 Ma
2023/0228094 A1 7/2023 Ma

FOREIGN PATENT DOCUMENTS

CN 105 083 143 11/2015
CN 105888366 4/2018

(56) References Cited

FOREIGN PATENT DOCUMENTS

| | | |
|---|---|---|
| DE | 2613583 | 3/1976 |
| DE | 2743748 | 4/1979 |
| DE | 31 10336 | 2/1982 |
| DE | 3801586 | 8/1989 |
| DE | 199 49 215 | 4/2001 |
| DE | 202008006223 | 9/2008 |
| DE | 20 2013 103994 | 11/2013 |
| EP | 0 001 592 | 2/1978 |
| EP | 0 119 550 | 9/1984 |
| EP | 0 810 336 | 12/1997 |
| EP | 1 092 820 | 4/2001 |
| EP | 1 342 864 | 9/2003 |
| EP | 1 609 926 | 12/2005 |
| EP | 1 767 721 | 3/2007 |
| EP | 1 895 070 | 3/2008 |
| EP | 1 995 391 | 11/2008 |
| EP | 2 071 982 | 6/2009 |
| EP | 2 280 129 | 2/2011 |
| EP | 2 565 342 | 3/2013 |
| EP | 2 565 343 | 3/2013 |
| EP | 2 607 570 | 6/2013 |
| EP | 1 964 998 | 6/2014 |
| EP | 3 144 444 | 3/2017 |
| EP | 3 312 360 | 4/2018 |
| ES | 2 342 802 | 7/2010 |
| FR | 2163097 | 7/1973 |
| FR | 2564521 | 11/1985 |
| FR | 2682713 | 4/1993 |
| FR | 2866854 | 10/1999 |
| FR | 2899659 | 10/2007 |
| GB | 2 291 901 | 2/1996 |
| IT | MI 20121972 | 5/2014 |
| JP | S62-146828 | 9/1987 |
| JP | 2005213997 A | 8/2005 |
| JP | 5500613 | 5/2014 |
| JP | 2014-169563 | 9/2014 |
| JP | 6128894 B2 | 5/2017 |
| JP | 2020180461 A | 11/2020 |
| KR | 101320445 B1 | 10/2013 |
| KR | 20130006147 U | 10/2013 |
| KR | 102009362 B1 | 8/2019 |
| WO | WO 1998/001638 | 1/1998 |
| WO | WO 2010/063386 | 6/2010 |
| WO | WO2013/121448 | 8/2013 |
| WO | WO2013/144561 | 10/2013 |
| WO | WO2014/170510 | 10/2014 |
| WO | WO2019/038229 | 2/2018 |
| WO | WO2018/224704 | 12/2018 |
| WO | WO2019/150055 | 8/2019 |
| WO | WO2019/186213 | 10/2019 |
| WO | WO2019/238942 | 12/2019 |
| WO | WO2020/121356 | 6/2020 |
| WO | WO2020/121357 | 6/2020 |
| WO | WO2020/121358 | 6/2020 |
| WO | WO2020/174195 | 9/2020 |

OTHER PUBLICATIONS

Extended European Search Report in Application No. EP 09 25 1792, dated Feb. 3, 2012 in 11 pages.

Extended European Search Report issued in European Application No. 14158518.2, dated May 16, 2014 in 9 pages.

Extended European Search Report in Application No. 18020200.4 dated Dec. 21, 2018, in 9 pages.

* cited by examiner

AWNING APPARATUS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 C.F.R. § 1.57.

BACKGROUND

Field of the Invention

This application is directed to an awning apparatus, which is a retractable device to provide shade or other shelter from the elements.

Description of the Related Art

Awnings are well known, convenient devices that provide shade and shelter. Often awnings are retractable so that they can be out of the way when shade or shelter is not needed. Certain retractable awnings employ folding arms that can be coupled with an extendable end of a canvas structure to pull the extendable end outward away from a building to which the awning is coupled.

Sometimes awnings are configured to allow extendable arms to be retracted into a housing that is mounted to a building or other structure. The housing protects the extendable arm and the canvas structure from the elements when not in use. The housing also can enhance the appearance of the retracted awning by hiding the mechanism and other utilitarian components of the awning from view.

While extendable arms are known to be retractable into a housing, there is a need for improved devices of this type.

SUMMARY

One type of awning that has become popular is one that allows an extendable end of canvas or other shade providing structure to be positioned at a lower elevation under some shade conditions. In some cases, a lower elevation position of the extendable end can be selected by adjusting a mechanism of the awning. In some prior art awnings a lower elevation position of the extendable end was provided, but such position prevented the retractable arms from being properly retracted into a housing of the awning. This can be particularly challenging for compact cassette and semi-cassette awnings. An improved mechanism or other arrangements enabling the elevation of the extended end of a retractable arm to be adjusted downward to a lower elevation position while still assuring that the retractable arm is properly retracted into a housing is needed.

Improved cassette awnings disclosed herein provide that an elevation of an extended end of a shade structure is in some examples automatically, e.g., simultaneously with retraction, adjusted upward to align the extended end with an opening into a housing. In some cases the extended end is configured to be retracted into or to close the opening in the cassette awning.

Improved awnings disclosed herein provide a degree of freedom of adjustment, e.g., rotation about a horizontal axis, to allow a front support or other outer end of a shade structure of the awning to be aligned with an opening of a housing of the awning upon retraction.

Improved awnings disclosed herein provide a limit on motion about at least one degree of freedom of adjustment, e.g., rotation about a horizontal axis, to prevent unwanted motion in at least one state of the awning. The awnings disclosed herein can limit such motion when the awning is fully extended.

In one embodiment, an awning is provided that includes a housing, a roller assembly disposed in the housing, and an extendable arm that has an inner end supported from within the housing and an outer end extendable away from the housing. The awning also has a front support coupled with the outer end of the extendable arms. The awning has a shelter member that has an outer portion coupled with the front support and disposed along the extendable arms. The awning also has a first mechanism adapted to adjust the orientation of the shelter member from a first extended orientation to a second extended orientation. The second extended orientation is at a higher angle from horizontal than the first extended orientation. The awning has a second mechanism responsive to a vertical force to raise the front support and the outer portion of the shelter member toward an angle corresponding to the first extended position.

In one variation of the foregoing embodiment, the front support is configured as a bar that extends between two extendable arms and that is coupled with, e.g., directly connected to the shelter member. The shelter member can be a canvas or other durable fabric suited for long term use in outdoor conditions. In another variation the front support is optional. For example, an outer portion of the shelter member can be connected directly to an outer end of one or more extendable arms.

In another embodiment, an awning is provided that includes an extendable arm, a shelter member, and a joint. The extendable arm has an inner end coupled with a support and an outer end extendable away from the inner end. The shelter member has an outer portion coupled with the extendable arm support and disposed along the extendable arm. The joint has a mechanism responsive to an awning retraction force to raise outer portions of the extendable arms and an outer portion of the shelter member toward a horizontal orientation relative to a shade enhancing orientation.

In another embodiment a joint for an awning is provided that includes an arm coupler, a first mechanism, and a second mechanism. The first mechanism has a threaded actuator for adjusting an orientation of the arm coupler from a first extended orientation to a second extended orientation. The second extended orientation is at a higher angle from horizontal than the first extended orientation. The second mechanism has a bracket pivoted to the first mechanism and responsive to a vertical force to raise the arm coupler toward an angle corresponding to the first extended position.

In another embodiment, a method of retracting an awning is provided. An initial force for retracting a shelter member of the awning is applied to gather the shelter member in a housing. A further force is applied to continue to retract the shelter member, to continue to gather the shelter member in the housing. A final force is applied to complete retracting the shelter member into the housing. The initial force retracts the shelter member without lifting the outer end of the shelter member. The further force lifts the outer end of the shelter member while retracting the shelter member. The final force retracts the awning into the housing without interference from the housing.

DETAILED DESCRIPTION

This application discloses and claims various improved awning apparatuses that can improve shade structure and that can provide for more reliable storage of the awning.

Figure 1A:
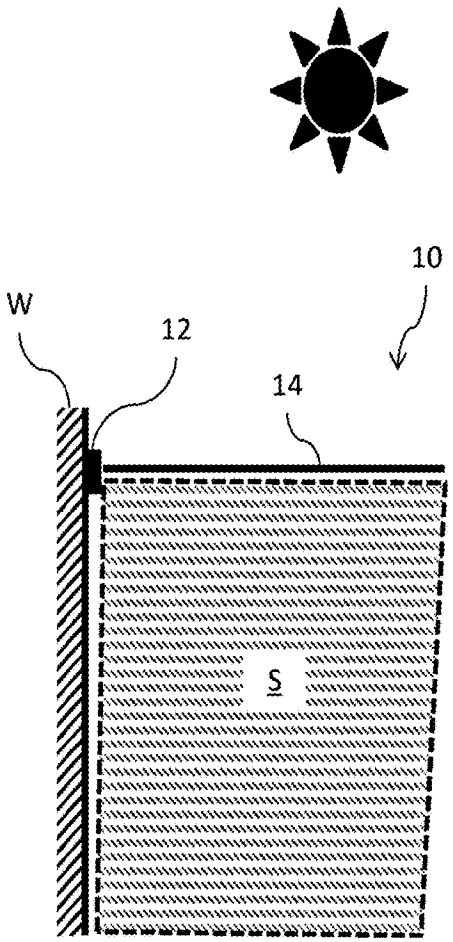
FIG. 1A Prior Art
FIG. 1A illustrates shade providing performance of an awning in a first configuration with the sun directly overhead.
Figure 1C:
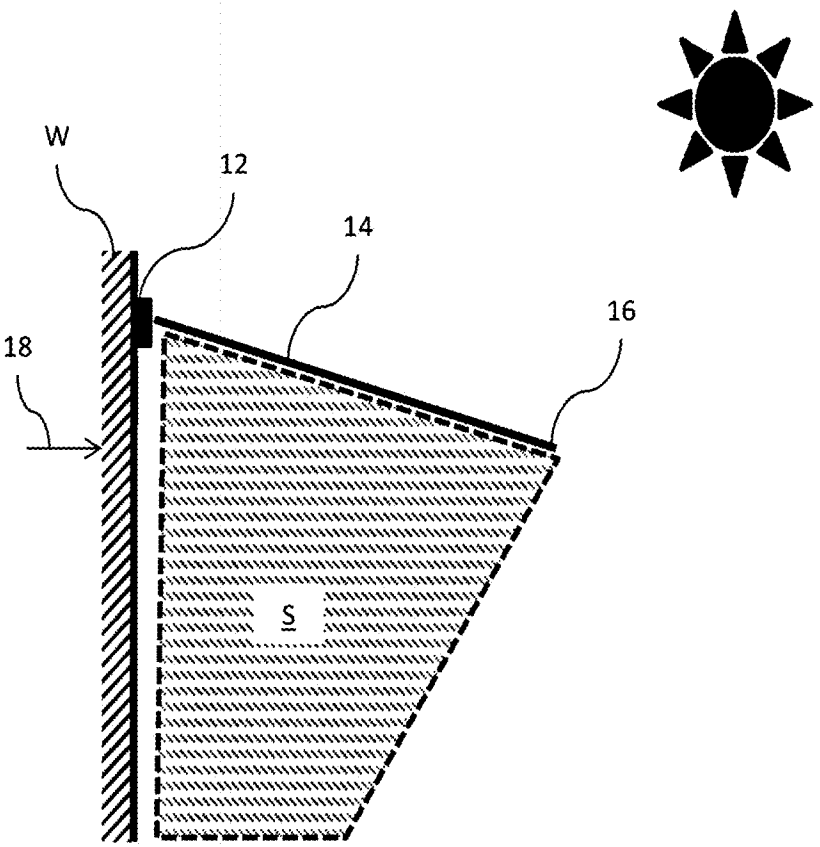
FIG. 1C Prior Art
FIG. 1C illustrate the awning in a second configuration enhancing the shade performance with the sun lower in the sky, as illustrated in FIG. 1B.
Figure 1B:
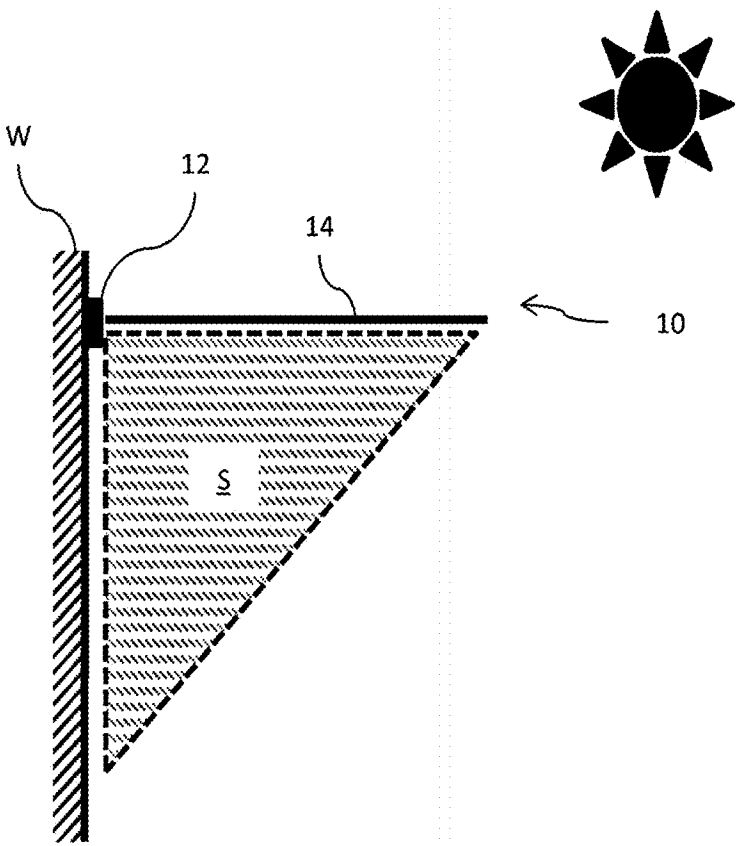
FIG. 1B Prior Art
FIG. 1B illustrates shade providing performance of the awning in the first position with the sun lower in the sky, e.g., earlier or later in the day, than the position illustrated in FIG. 1A.

FIG. 1A shows an awning apparatus providing excellent shade during the middle part of a day when the sun is directly overhead. The awning 10 is extended from the wall W. The awning 10 generally includes a housing 12 and an extendable shade structure 14 that blocks the sun providing shade S. FIG. 1A shows that when the sun is overhead the extendable shade structure 14 can be extended, and when extended the shade S is plentiful. FIG. 1B shows the extendable shade structure 14 in in the same position or configuration as shown in FIG. 1A. FIG. 1B shows that as the sun transitions to lower in the sky the shade S decreases. FIG. 1C shows the sun in the same position as in FIG. 1B and shows a modified configuration of the awning 10 in which the outer end of the extendable shade structure 14 is lowered compared to the end adjacent to the wall W and also is lowered from the position shown in FIGS. 1A and 1B. FIG. 1C shows that the shade S is much improved for the sun position of FIGS. 1B and 1C with the modified configuration of the extendable shade structure 14.

FIG. 1C shows an arrow 18 that indicated the elevation difference between the location of the housing 12 and the end of the extendable shade structure 14 away from the wall W. Although the elevation distance is beneficial for the reasons discussed above, a problem can arise when the extendable shade structure 14 is retracted into housing 12. The end of the extendable shade structure 14 away from the housing 12 in the extended configuration may not fully return to the elevation shown in FIG. 1A. For example, in one embodiment the lower elevation shown in FIG. 1C is provided by hand cranking a mechanism. Unless the user counts the number of cranks to reach the lowered position and counter-cranks the same number of times, the elevation of the outer end will not be the same as when extended, e.g., as in FIG. 1A. This can prevent the extendable shade structure 14 from being fully retracted into the housing 12.

Figure 2:
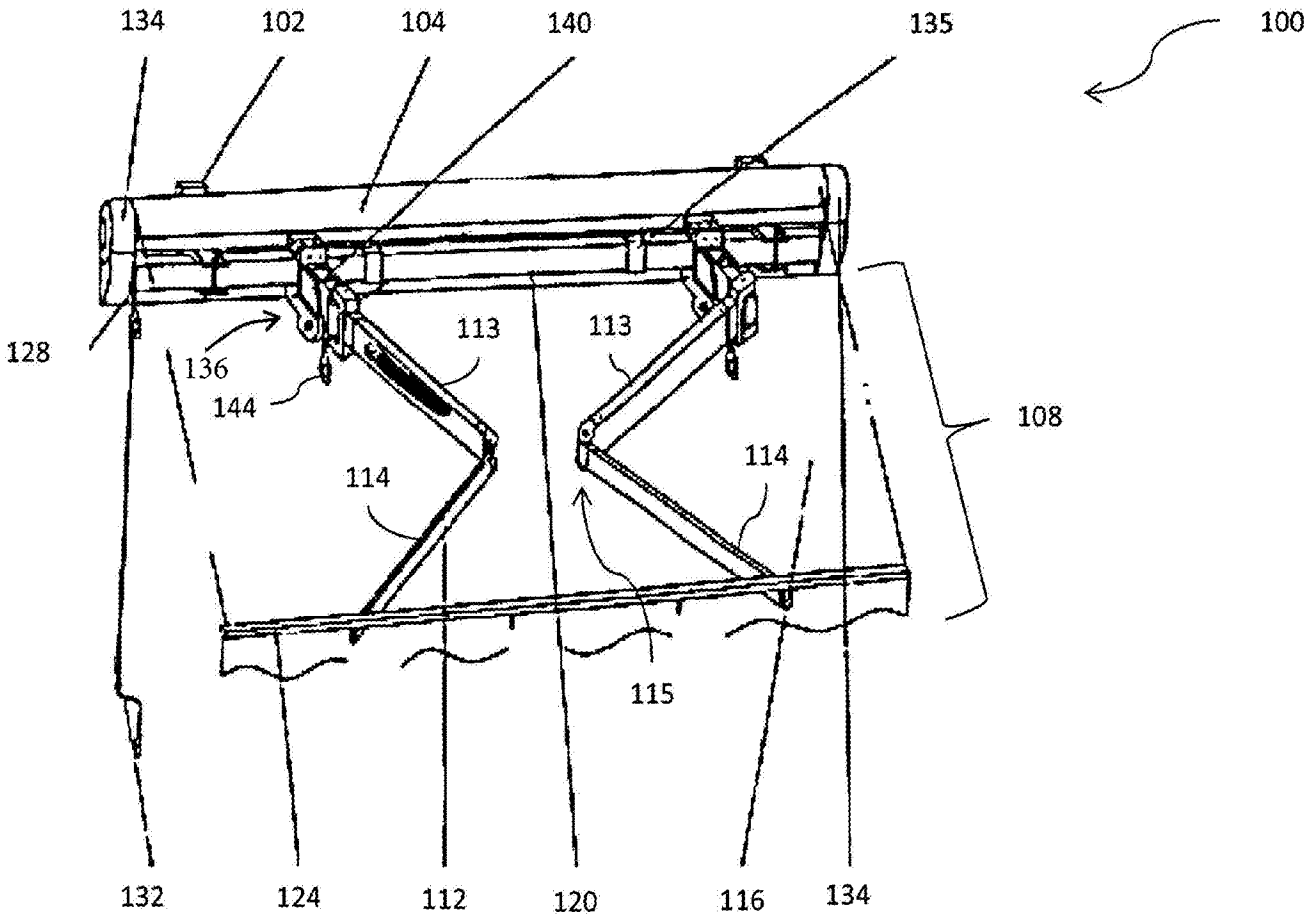
FIG. 2 shows components of various embodiments of the awning apparatus.

FIG. 2 shows an awning assembly 100 that can be mounted to a wall. The awning assembly 100 includes a wall base 102 that can be anchored to the wall. The wall base 102 can support a housing 104. A shade structure 108 can be extended from and stored in the housing 104. The shade structure 108 can take many different forms, but generally includes one or more, e.g., a plurality of or two extendable arms 112 and a shelter fabric 116. The shelter fabric 116 can be a durable material such as a canvas. The extendable arms 112 can include an inner member 113, and outer member 114, and a joint 115 disposed between the inner member 113 and the outer member 114. The shelter fabric 116 is coupled at an inner end thereof to a rear support 120 and is coupled at an outer end with a front support 124. The shelter fabric 116 can be coupled with the rear support 120 by a roller assembly 128. The roller assembly 128 is used to roll up the shelter fabric 116 such that the shelter fabric 116 is in a low-profile configuration when stored. The roller assembly 128 can include a roller or drum about which the shelter fabric 116 is wound. The roller assembly 128 can be driven manually, e.g., by a hand crank 132. The roller assembly 128 can be driven by a motor.

The roller assembly 128 can be installed in the housing 104 by removing a cap 134 providing access from a side of the housing 104. The housing 104 can also have one or a plurality of supports 135 for holding the roller assembly 128.

FIG. 2 shows that the awning assembly 100 also can include an adjustment and retraction joint 136. The adjustment and retraction joint 136 is configured to enable the outer end of the outer member of the front support 124 to be lowered in elevation. The adjustment and retraction joint 136 can provide the performance benefits of FIG. 1C. That is, the adjustment and retraction joint 136 enables the user to lower the front support 124 and as a result to lower an outer portion of the shelter fabric 116 causing the shade S to be increased when the sun is low in the sky. The adjustment and retraction joint 136 also is advantageously suited to move the front support 124 to an elevation for retraction into the housing 104 automatically or without requiring the user to adjust the elevation of the front support 124 as a separate step from retracting the front support 124.

With reference to FIGS. 3-7, the adjustment and retraction joint 136 can include an angle adjustment joint 140, which can be considered a first mechanism. The angle adjustment joint 140 is configured to adjust the front support 124 from a first elevation (e.g., as illustrated in FIG. 1B) to a second elevation (e.g., as illustrated in FIG. 1C). The angle adjustment joint 140 can take any suitable form. For example, the angle adjustment joint 140 can include a rotatable actuator 144 that can be releasably engaged by the hand crank 132. The rotatable actuator 144 can turn to cause the front support 124 to be raised or lowered.

Figure 4:
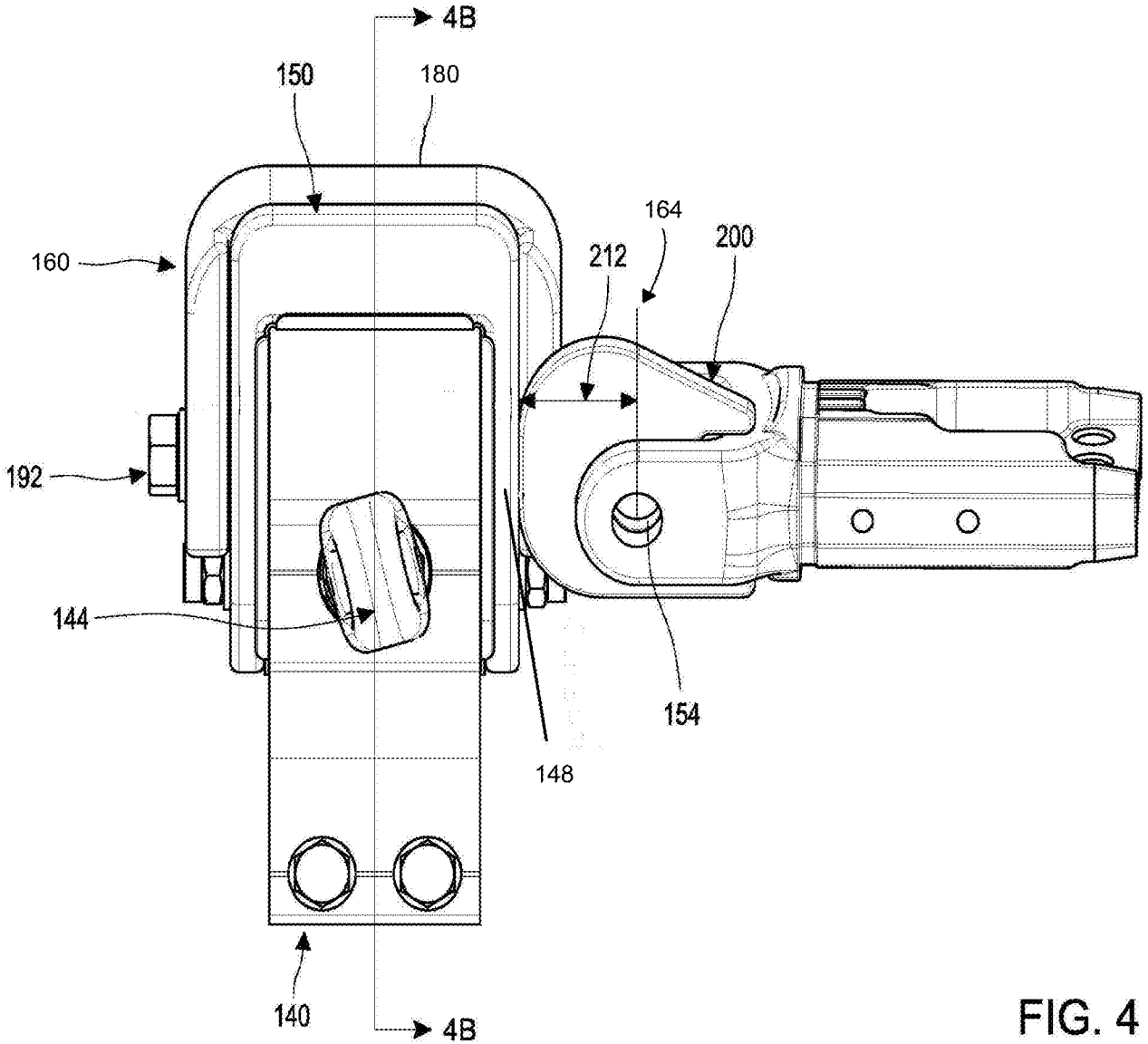
FIG. 4 is a bottom view of the awning joint embodiment of FIG. 3, the awning joint shown in a retracted configuration.
Figure 4A:
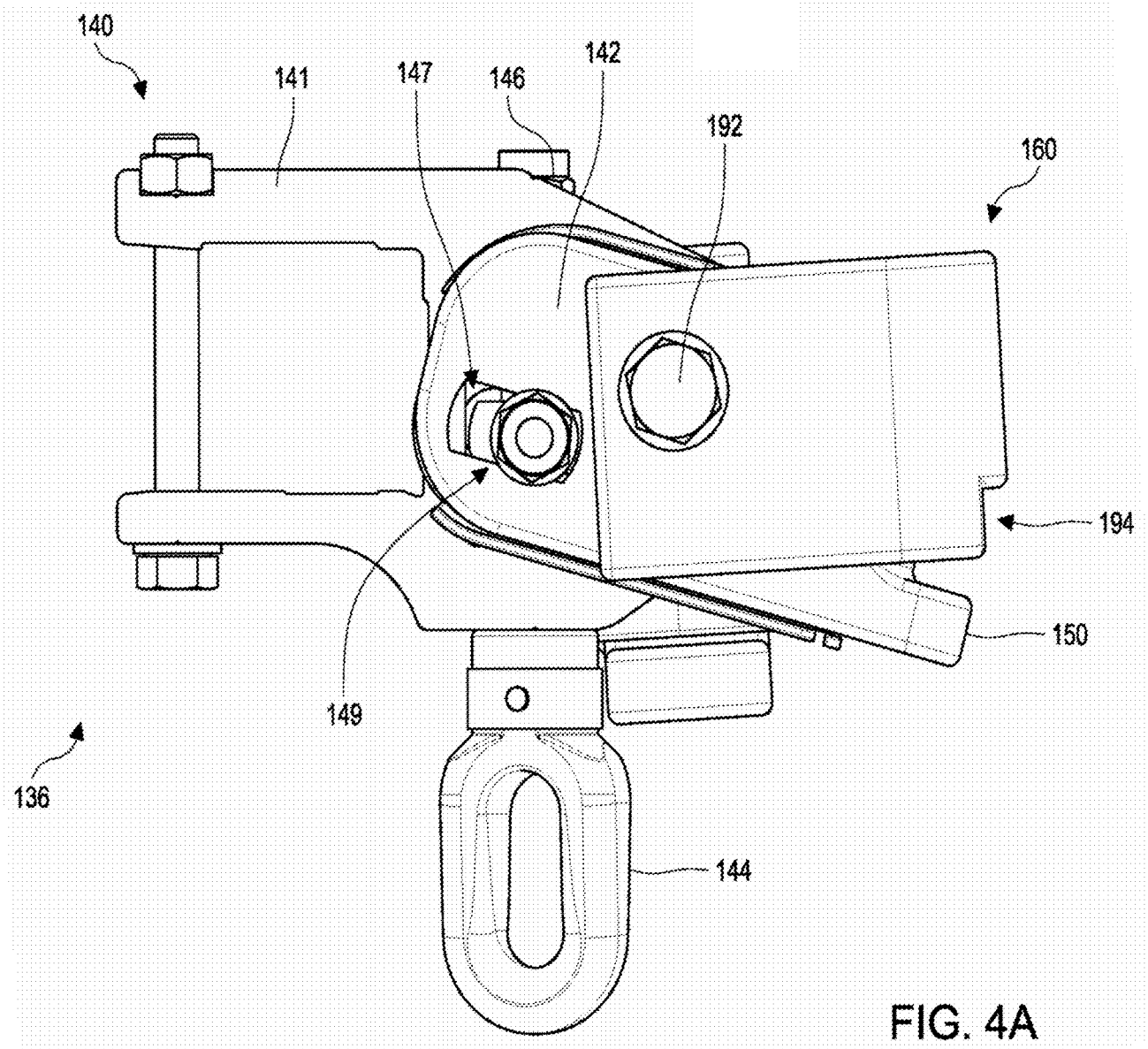
FIG. 4A is a side view of the awning joint embodiment of FIG. 4, the awning joint shown in a retracted configuration with a retraction joint in an elevated position.
Figure 4B:
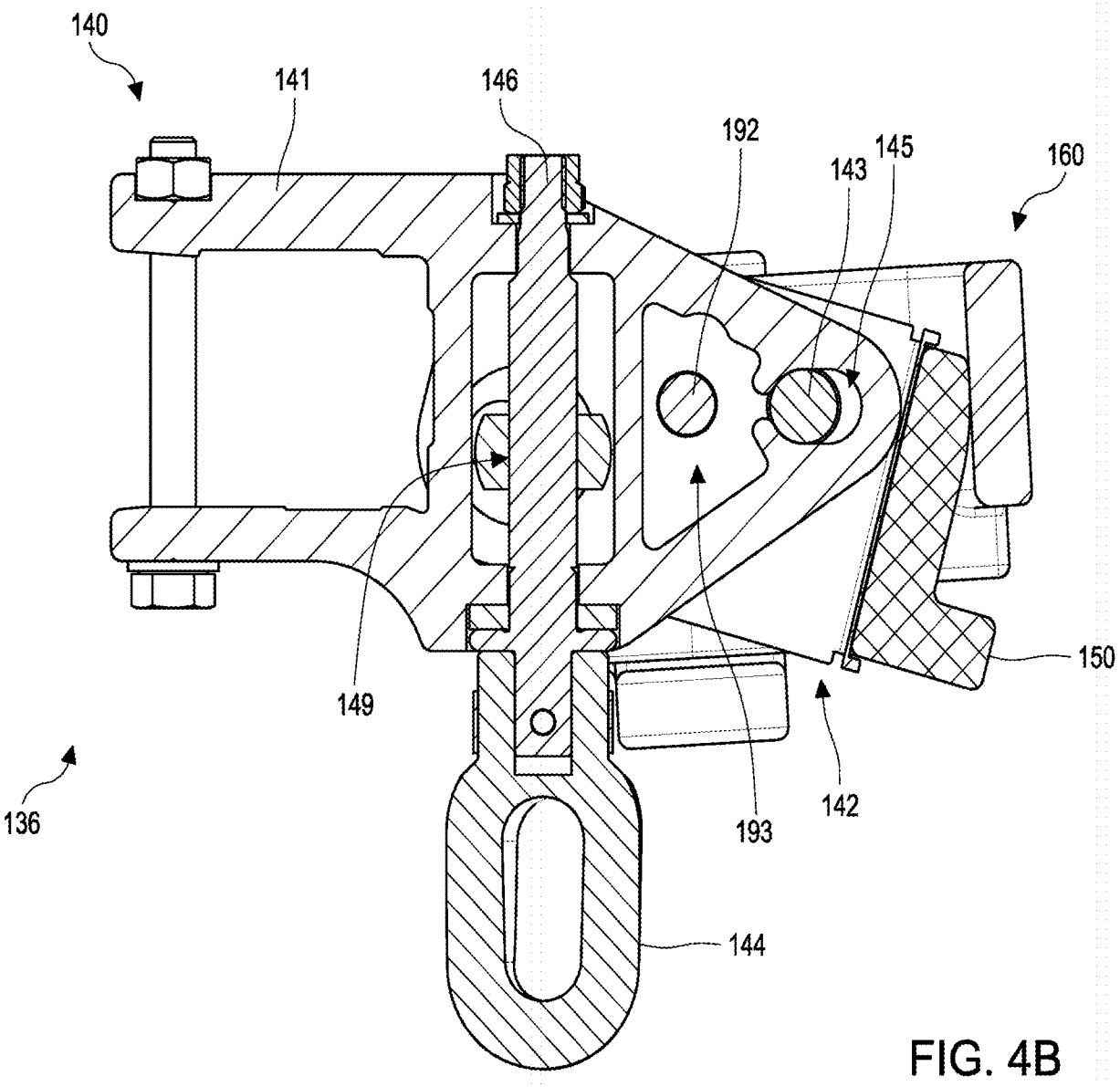
FIG. 4B is a section view of the awning joint embodiment of FIG. 4, the awning joint shown in a retracted configuration with the retraction joint in an elevated position.
Figure 5:
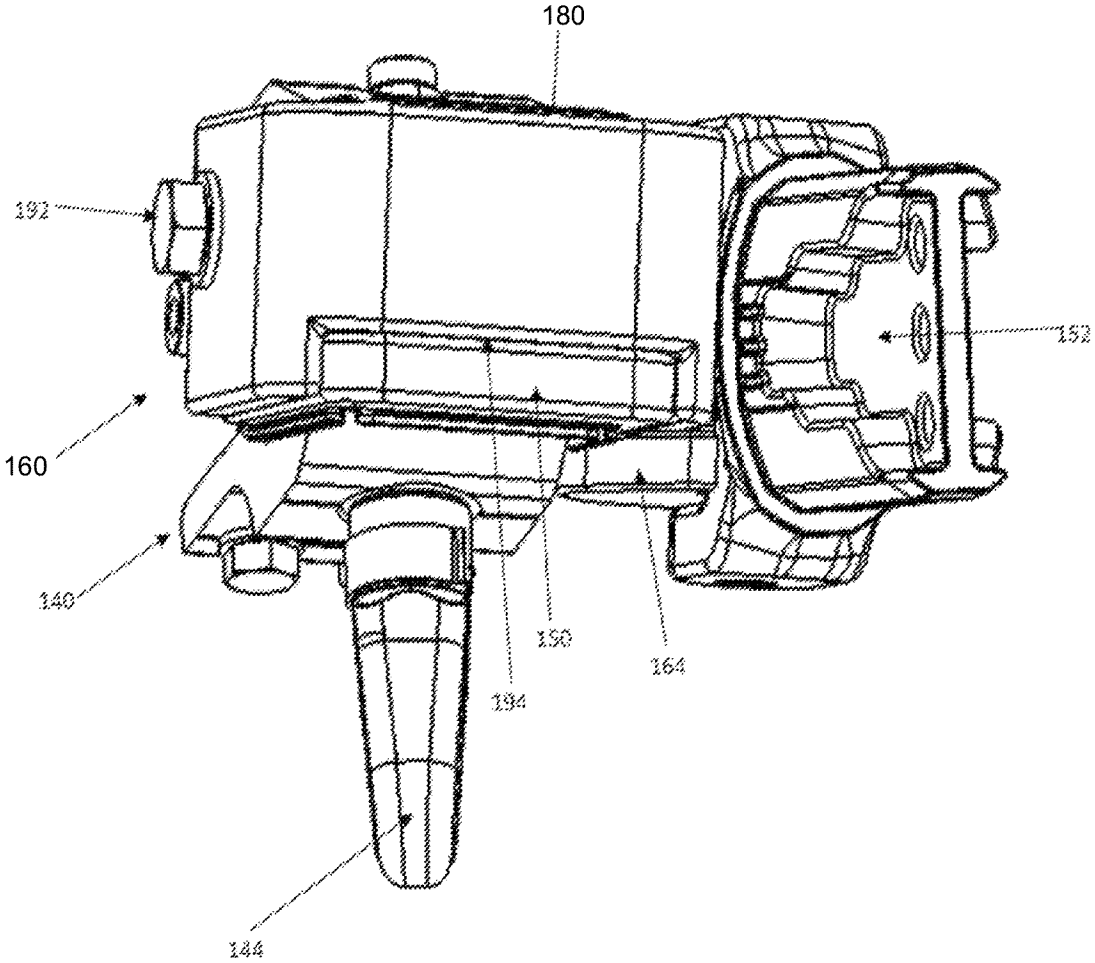
FIG. 5 is a bottom perspective view of the awning joint embodiment of FIG. 3, the awning joint being shown in a configuration corresponding to extendable arms being extended.

As shown in FIGS. 4A and 4B, the angle adjustment joint 140 can be configured in a manner similar to the adjustable joint in US7163042B1, which is hereby incorporated by reference herein. The angle adjustment joint 140 can include a supporting seat 141 and an adjustment member 142. The supporting seat 141 can be mounted to the wall base 102, such as by one or more bolts. The supporting seat 141 can include an aperture or slot 145. The adjustment member 142 can be pivotally connected to the supporting seat 141 by a supporting shaft 143 at the slot 145. The adjustment member 142 can be pivotally and translatably coupled with the supporting seat 141 by the slider shaft 149 at an elongated through slot 147. The connections of the adjustment member 142 with the supporting seat 141 can be spaced apart, e.g., on opposite ends of the adjustment member 142. The supporting shaft 143 can be oriented in a horizontal direction. The slider shaft 149 can pass through the elongated through slot 147 to slidably mount the adjustment member 142 to the supporting seat 141.

In one advantageous embodiment, movement of an adjustment member similar to the adjustment member 142 can be provided without including a mechanism to automatically adjust the elevation of the front support 124 during retraction. In other words, an awning can be provided where the motion from a more horizontal state to a more angled state (as from the state of FIG. 1A to the state of FIG. 1C) can be provided by movement of the actuator 144 causing motion of the slider shaft 149 in the slot 147. A corresponding movement of the shaft 143 in the slot 145 can enhance the motion provided as a result of the movement of the actuator 144. The slot 145 provides some play in movement of the shaft 143 that can ease the downward tilting of the awning. In some embodiments, the more angled state can be secured using the limiter 164 when the awning in the extended state. Retracting this embodiment can commence with adjusting the actuator 144 until the awning is in the more horizontal state as in FIG. 1A and then folding the arms at the adjustment and retraction joint 136.

By providing the through slot 147 and the slot 145 for connection with the supporting seat 141, as in some implementations, the adjustment member 142 can be afforded an additional degree of adjustability of the relative position between the adjustment member 142 and the supporting seat 141 (e.g., as compared with a single slot and pin aperture having a uniform circumference, which would provide only a rotation about the pin aperture as the single degree of freedom). The adjustment member 142 can rotate and/or translate in small amounts with respect to the supporting seat 141 about the slider shaft 149 (primarily providing translation) and the supporting shaft 143 (primarily acting as a pivot point, but also allowing translation where the slot 145 is included).

The slider shaft 149 can be threadingly mounted on a retaining pin assembly 146. The retaining pin assembly 146 can be rotatably mounted on the supporting seat 141 in a generally vertical orientation. The retaining pin assembly 146 can be coupled with the rotatable actuator 144. The supporting seat 141 can include a central slot or aperture housing the retaining pin assembly 146. Rotation of the rotatable actuator 144 can turn the retaining pin assembly 146 to translate the slider shaft 149 along the generally vertical direction. Translation of the slider shaft 149 can rotate the adjustment member 142 about the supporting shaft 143. By rotation of the rotatable actuator 144, the angle of the adjustment member 142 with respect to the supporting seat 141 can be selectively adjusted. The adjustment member 142 (and the inner member 113) can be tilted generally about the supporting shaft 143 to cause the front support 124 to be raised or lowered (e.g., angled downwards or upwards) to orient the canopy.

The adjustment member 142 can also include a lower periphery 148. A projection 150 can be provided on the lower periphery 148 to interact with a retraction joint 160 of the adjustment and retraction joint 136.

The retraction joint 160, which can be considered a second mechanism, is one example of a structure that can provide an additional degree of freedom in the awning assembly 100. The retraction joint 160 can provide for rotation about a horizontal axis as discuss further below. The degree of freedom provided by the retraction joint 160 facilitates alignment of the front support 124 with the housing 104 upon retraction as discussed further below. The retraction joint 160 can provide for rotation about with respect to the adjustment member 142 about an axle 192.

Although the retraction joint 160 is shown integrated into the adjustment and retraction joint 136 between the inner member 113 and the housing 104, the function of the joint can be provided at other locations on various modified embodiments. For example the function of the retraction joint 160 can be integrated into the joint 115 between the inner member 113 and the outer member 114. The function of the of the retraction joint 160 can be provided between the joint 115 and the front support 124, e.g., between the outer end of the outer member 114 and the front support 124.

The adjustment and retraction joint 136 also includes an arm coupler 152 that is coupled to the adjustment and retraction joint 136 by an axle 154 at one end. An opposite end of the arm coupler 152 is coupled in the illustrated embodiment with an inner member of one or both of the extendable arms 112. The opposite end of the arm coupler 152 and the inner member can be coupled in any suitable manner, such as by interference fit, by fasteners or by other structures.

The retraction joint 160 provides unique advantages in the retraction of the shade structure 108. The retraction joint 160 provides motion about a horizontal axis to allow for undeflected position during retraction. A limiter 164 is provided in the adjustment and retraction joint 136 to limit the motion about a horizontal axis as discussed further below.

Figure 3:
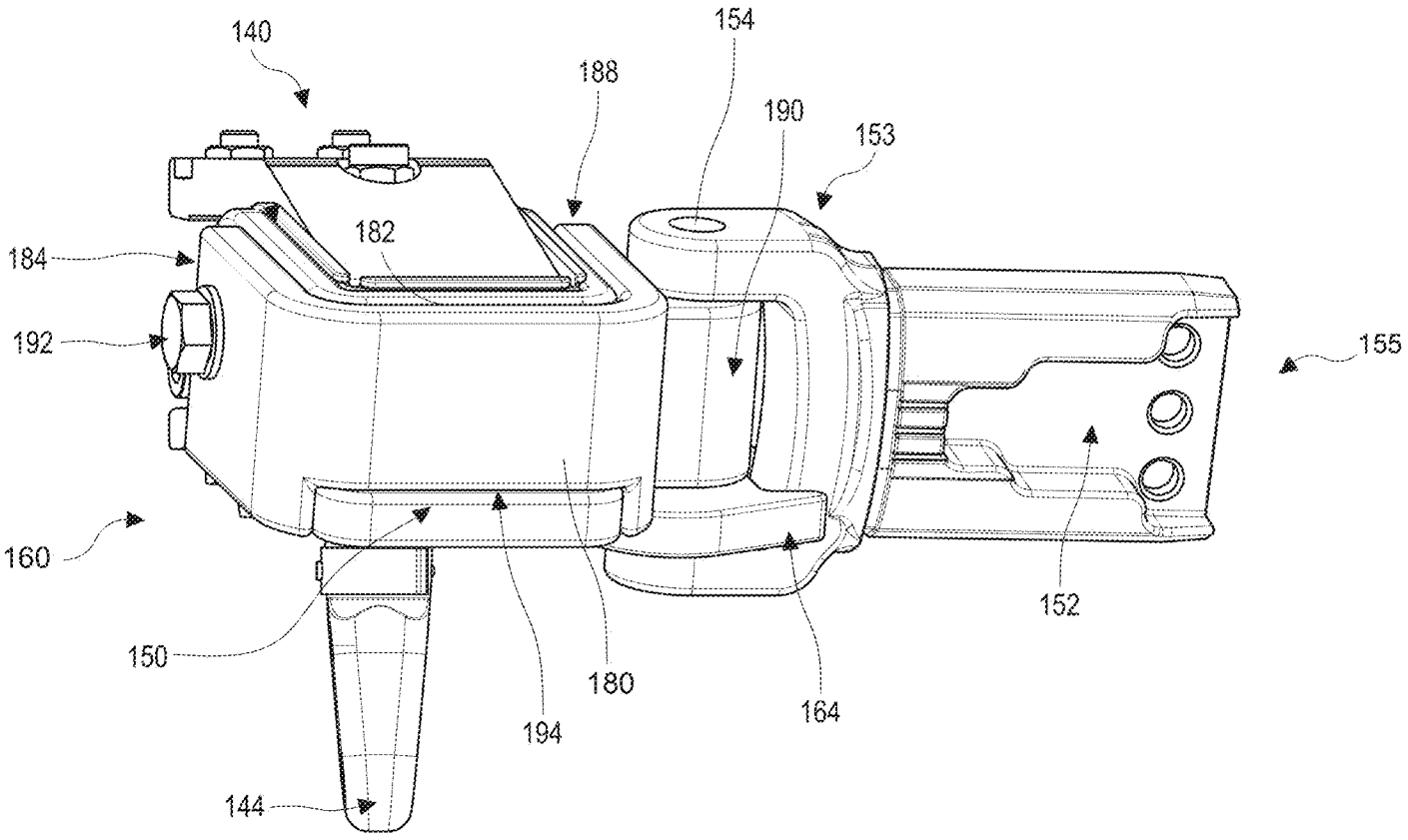
FIG. 3 is a top perspective view of one embodiment of an awning joint adapted for supporting an extendable arm assembly, the awning joint being shown in a configuration corresponding to the extendable arms being retracted.

The retraction joint 160 includes a structure that allows the joint to rotate. The retraction joint 160 can include a u-shaped flange 180. The u-shaped flange 180 can include an inwardly facing bight 182. The inwardly facing bight 182 faces away from the front support 124 and toward a wall or other support structure to which the awning assembly 100 is mounted. The inwardly facing bight 182 can be defined between a first end 184 and a second end 188. The u-shaped flange 180 can also be coupled with or can have integrally extending therefrom a cylindrical member 190. The cylindrical member 190 enables the u-shaped flange 180 and the adjustment and retraction joint 136 to be coupled with the axle 154 and with the arm coupler 152. FIG. 3 shows that the axle 154 extends through fork portions 153 of the arm coupler 152 and through the cylindrical member 190 of the u-shaped flange 180. This arrangement allows the arm coupler 152 (and the inner portion of the extendable arm to which it is coupled) to rotate about the axle 154 (and thereby about a vertical axis) and to rotate about a horizontal axis as provided by the structure of the retraction joint 160.

Rotation of the u-shaped flange 180 about a horizontal axis can be provided by an axle 192 that extends horizontally through the adjustment and retraction joint 136. The axle 192 extends through the first end 184 and the second end 188 of the u-shaped flange 180. The axle 192 extends through a hollowed out portion 193 of the adjustment member 142 in one embodiment, as shown in FIG. 4B. The hollowed out portion 193 accommodates motion of axle 192 as it moves with the adjustment member 142 with respect to the supporting seat 141, without which the axle 192 would interfere with the supporting seat 141 and/or with the motion of the adjustment member 142. The axle 192 enables the u-shaped flange 180 to pivot such that an outer portion thereof (in this context outer meaning away from the wall or other support to which the awning assembly 100 may be coupled) can be raised or lowered. This motion is translated directly in some embodiments into a raising and lowering of at least an outer end 155 of the arm coupler 152 due to the arm coupler 152 being coupled with the u-shaped flange 180, e.g., by the cylindrical member 190. Raising or lowering of at least the outer end 155 of the arm coupler 152 corresponds to raising or lowering the inner member 113 of the extendable arms 112 of which the inner member 113 is a part.

The retraction joint 160 and the axle 192 can operate independently of the angle adjustment joint 140 such that the position of the arm coupler 152 and the extendable arms 112 coupled therewith can be changed by a force applied to the shade structure 108. A force applied to the front support 124 can be applied from the roller assembly 128, e.g., by rotating a roller thereof in a direction to tension and to roll up the shelter fabric 116. Such a force can be resolved into a vertical component and a horizontal component. The vertical component of the force can have a lifting effect on the shade structure 108, particularly on the outer end thereof, e.g., on the front support 124.

The motion of the u-shaped flange 180 of the retraction joint 160 can have one or more limiting structures. In one embodiment, the u-shaped flange 180 has a downward facing bight 194 that can allow the u-shaped flange 180 to engage the angle adjustment joint 140. As noted above, the angle adjustment joint 140 can have a projection 150. The downward facing bight 194 can be sized to fit over the projection 150. The projection 150 can have an outward extent that is the same as or more than the thickness of the u-shaped flange 180 such that the bottom surface of the u-shaped flange 180 can be fully supported by the projection 150. The projection 150 is a vertical limiter on downward rotation of the retraction joint 160 about a horizontal rotation axis through the axle 192. In the absence of an upward force, the orientation of the arm coupler 152 when extended (and the extendable arm coupled therewith) is provided when the downward facing bight 194 is disposed over and engages the projection 150. An upward force applied to the arm coupler 152, e.g., from the outer end of the shade structure 108 can lift the u-shaped flange 180 relative to the angle adjustment joint 140. A downward force would not allow the shade structure 108 to be moved downwardly in the extended configuration beyond the point when the downward facing bight 194 engages the projection 150.

Upward motion of the shade structure 108 is limited in some embodiments by structures that prevent such motion. In other embodiments, gravity can limit upward motion which can be sufficient to control the orientation of the shade structure 108 when extended. For those embodiments where specific limit on unintended upward motion is desired the limiter 164 can be provide. The limiter 164 can provide active limitation on motion of the shade structure 108. The limiter 164 actively limits in one status or configuration, such as when the shade structure 108 is fully extended. The limiter 164 can be inactive in one status or configuration, such as during retraction of the shade structure 108 or when the shade structure 108 is fully retracted. The limiter 164 can take any suitable form. In one embodiment the limiter 164 includes a plate member 200 that can be disposed between the angle adjustment joint 140 and the retraction joint 160. In some embodiments the plate member 200 can be disposed over or under a portion of the angle adjustment joint 140 to resist motion of the retraction joint 160 relative thereto in at least one direction. The plate member 200 can be disposed below a portion of the angle adjustment joint 140 in at least one configuration of the awning assembly 100.

In one embodiment, the plate member 200 includes an aperture and is disposed about the axle 154. The plate member 200 can be disposed between the cylindrical member 190 and a lower portion of a fork portion of the arm coupler 152. The plate member 200 can be configured to rotate into a position at least partially below the angle adjustment joint 140 when the arm coupler 152 is in an extended position. The plate member 200 can be configured to rotate into a position not below the angle adjustment joint 140 when the arm coupler 152 is in a retracted position. When the plate member 200 rotates such to not be below the angle adjustment joint 140 a force applied to the shade structure 108 with an upward component can lift the shade structure 108, e.g., the front support 124 and the outer end of the shelter fabric 116 from a position corresponding to FIG. 1C to a position corresponding to FIG. 1A.

Figure 6:
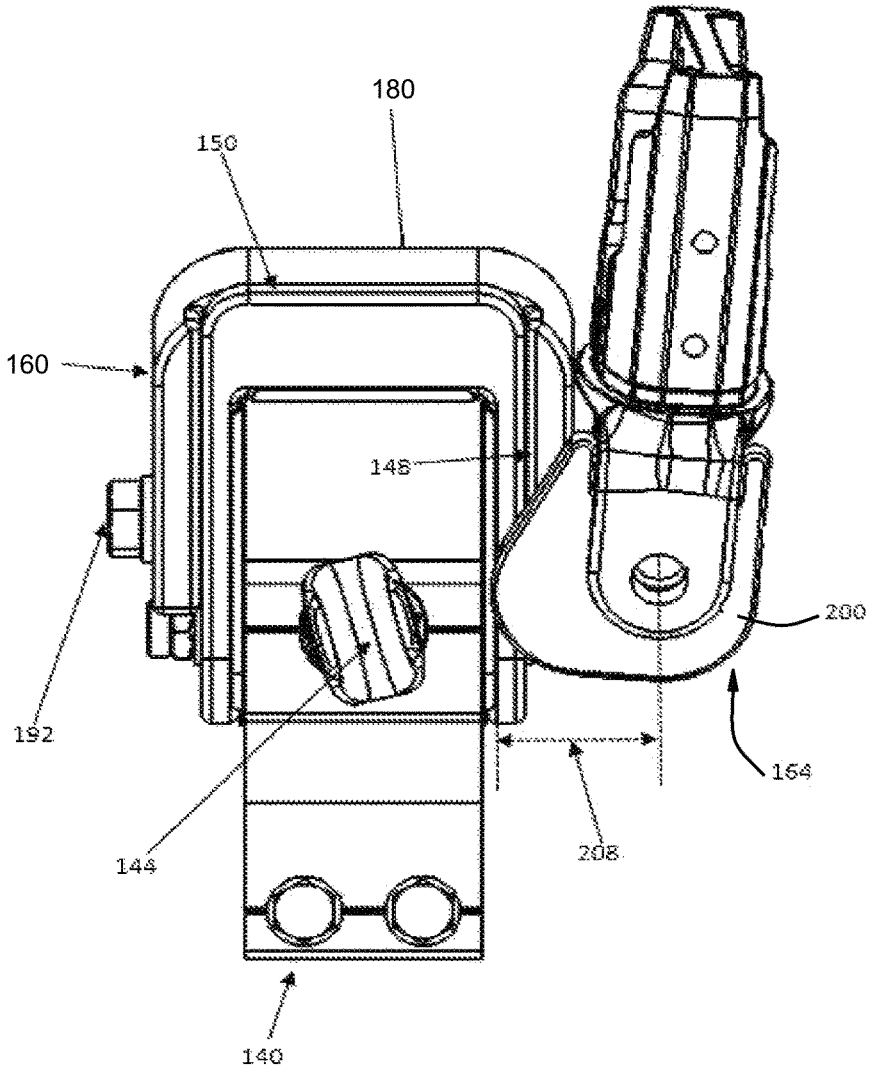
FIG. 6 is a bottom view of the configuration of the awning joint embodiment of FIG. 3, shown in the extended configuration of FIG. 5.

The plate member 200 can have an asymmetric shape providing the configurations for blocking rotation of the retraction joint 160 about a horizontal axis and for not blocking such rotation. The asymmetric shape can include a first extent 208 and a second extent 212 as shown in FIGS. 4 and 6, respectively. The first extent 208 can be oriented in a direction transverse to a longitudinal axis of the arm coupler 152 and also of the extendable arms 112 when extended. The first extent 208 can be greater than the distance between the rotation axis of the axle 154 and the lower periphery 148 such that when the first extent 208 is disposed toward the lower periphery 148 the lower periphery 148 is disposed over or otherwise overlaps the plate member 200. FIG. 6 shows that in one arrangement, the first extent 208 is directed toward the lower periphery 148 when the arm coupler 152 is extended. FIG. 6 shows a status or configuration in which the interaction between the first extent 208 and the lower periphery 148 actively prevents rotation of the retraction joint 160 about the axle 192.

The second extent 212 preferably is less than the first extent 208. The second extent 212 can be oriented along the longitudinal axis of the arm coupler 152. The second extent 212 can extend away from the arm coupler 152 along the longitudinal axis of the arm coupler 152. FIG. 4 shows that in one embodiment the second extent 212 can be disposed away from the angle adjustment joint 140 in at least one configuration of the awning assembly 100. The second extent 212 can be less than the distance between the rotation axis of the axle 154 and the lower periphery 148 of the angle adjustment joint 140. This position allows the plate member 200 to rotate past the angle adjustment joint 140 without being block by the lower periphery 148 of the angle adjustment joint 140 to allow the shade structure 108 to be raised upon retraction as discussed further below. FIG. 4 thus shows a status or configuration of the limiter 164 in which a lack of interaction between the plate member 200 (e.g., in the first extent 208 or the second extent 212) and the lower periphery 148 provides status or configuration in which the retraction joint 160 can rotate about the axle 192. Such rotation enables an outer portion of the shade structure 108 to be aligned with the housing 104 automatically or simultaneously with retraction of the awning assembly 100 as discussed further below.

Figure 9:
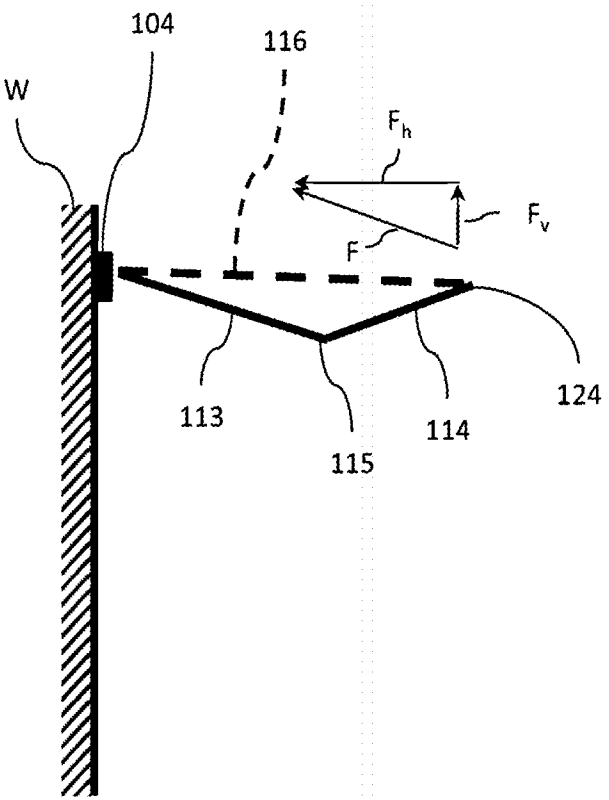
FIG. 9 is a schematic view of the awning of FIG. 2 showing continued application of force following that of FIG. 8 and the corresponding raising of the outer portion of the awning.
Figure 8:
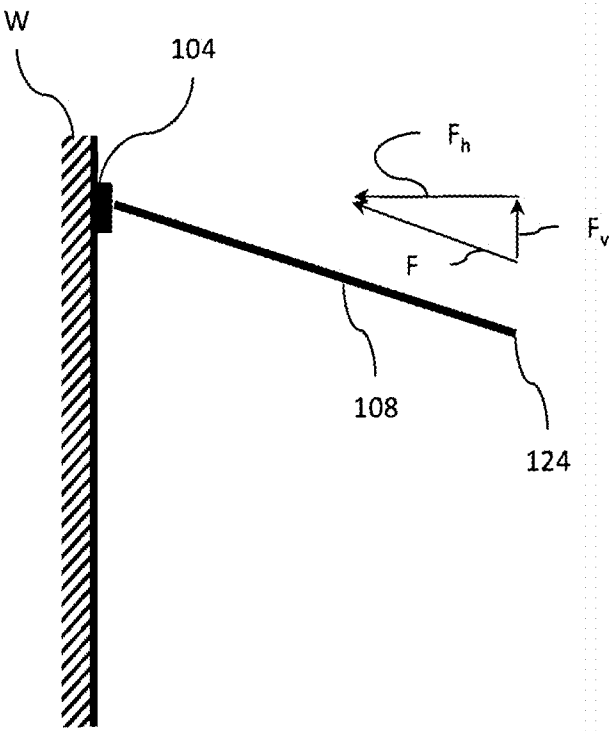
FIG. 8 is a schematic view of the awning of FIG. 2 showing forces initially transmitted to an outer portion thereof upon retraction of the awning.

FIGS. 8 and 9 show the process of retracting the awning assembly 100. In one arrangement a hand crank 132 is used to begin to retract the awning assembly 100 from the position shown in FIG. 2. A force F is transmitted along the shade structure 108, e.g., the front support 124. The force F can be resolved into horizontal force component Fh and vertical force component Fv. The vertical force component Fv lifts the front support 124 and the outer end of the shelter fabric 116 of the shade structure 108 as shown in an exaggerated manner in FIG. 9. The lifting of the front support 124 and the outer portion of the shelter fabric 116 is as a result of the retraction joint 160. The u-shaped flange 180 is allowed to pivot upward about the axle 192. The lifting of the front support 124 can be immediate if the limiter 164 is not present. If the limiter 164 is present the lifting of the front support 124 and the outer end of the shelter fabric 116 can be delayed until the plate member 200 rotates out of a projection of the angle adjustment joint 140. When the limiter 164 rotates out from under the lower periphery 148 the front support 124 and the outer portion of the shelter fabric 116 can begin to be lifted by the vertical component Fv of the force F.

Continued application of the force F causes the front support 124 and the shelter fabric 116 to be further drawn into the housing 104. For example, the vertical component force Fv can raise the front support 124 to an elevation above the lower boundary to an opening into the housing 104 and below the upper boundary to the opening into the housing 104 as shown schematically in FIG. 9. Upon full rotation of the arm coupler 152 and the extendable arms 112 coupled therewith, the arm coupler 152 and the extendable arms 112 will be aligned with the wall and in the housing 104. Prior to entering but when approaching the housing 104, the elevation of the front support 124 and the outer portions of the shelter fabric 116 will be set by the orientation of the u-shaped flange 180. The u-shaped flange 180 will be fully lifted aligning the front support 124 and the outer portion of the shelter fabric 116 with an opening of the housing 104. As the front support 124 and the shelter fabric 116 move into the housing 104 there will be no obstruction of entering the housing 104.

As discussed above, the function of the retraction joint 160 can be provided at the joint 115 or outward of the joint 115, e.g., between the outer member 114 and the front support 124. The initial application of the force F can provide vertical component Fv to lift the outer member 114 relative to the inner member 113. This arrangement can advantageously allow a lower vertical force Fv to provide vertical lifting of the outer member 114 and the rest of the outer portion of the shade structure 108 due to not having to raise the weight of the inner member 113. If the function of the retraction joint 160 is provided between the outer member 114 and the front support 124 an even lower vertical force component Fv can achieve lifting and alignment of the front support 124 and at least a portion of the shelter fabric 116 coupled therewith.

Figure 7:
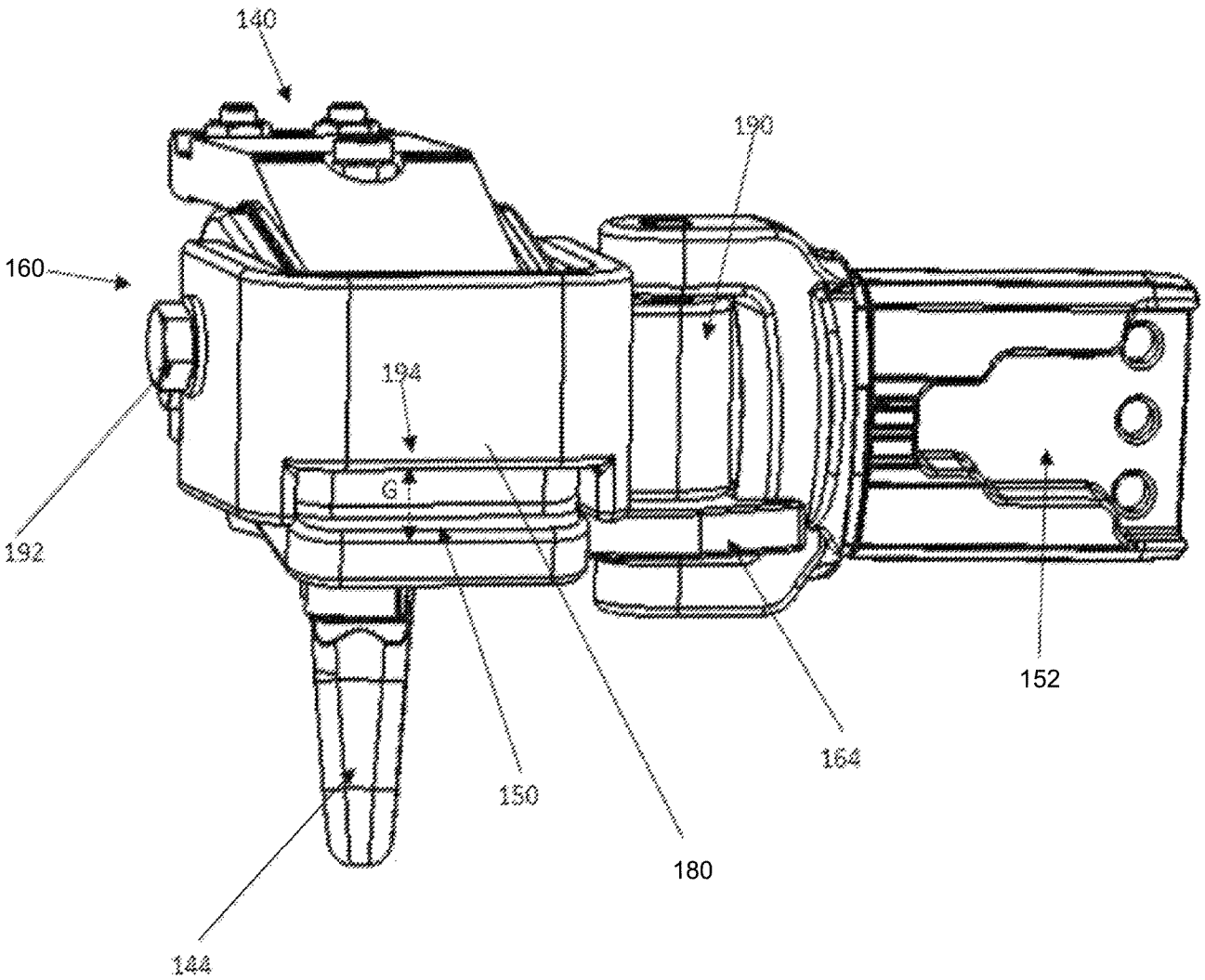
FIG. 7 is a top perspective view of the embodiment of the awning joint of FIG. 3 shown in a configuration for downwardly angling extendable arms of the awning joint, the awning joint being in a retracted configuration.

Another advantage of the awning assembly 100 is that a downward configuration of the shade structure 108 can be maintained even when the shade structure 108 is folded within the housing 104. FIG. 7 shows a gap G between the top of the projection 150 and the downward facing bight 194. The gap G defines the shade enhancing angle between horizontal and the top surface of the shelter fabric 116 or between horizontal and a plane connecting a rotation axis of a roller and a longitudinal axis of the front support 124. A load to maintain the gap G and to support the front support 124 can be carried by the shelter fabric 116. A separate support for the extendable arms 112 and the arm coupler 152 can be provided in the housing 104.

The foregoing provides a distinct advantage that the awning assembly 100 can be extended out of the housing 104. When so extended the adjustment and retraction joint 136 can be initially in a downwardly oriented configuration enabling the shade structure 108 to be oriented downwardly. The gap G can be closed as the extendable arms 112 is being extended. As the extendable arm(s) 112 is or are being extended, the retraction joint 160 can rotate downward about the horizontal of the axle 192 without separate input from the user. As the extendable arm(s) 112 is or are being extended the downward facing bight 194 can come down to rest on the projection 150. Thus, the downward orientation of the shade structure 108 can arise automatically from a single mechanism, e.g., from rotating the rotatable actuator 144 using the hand crank 132 or from a motor for example. On the other hand the rotatable actuator 144 can be rotated in the opposite direction to adjust the shade structure 108 to a horizontal configuration prior to retracting the shade structure 108 as discussed above and as illustrated schematically in FIGS. 8 and 9.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

The terms "approximately," "about," and "substantially" as used herein represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

Some embodiments have been described in connection with the accompanying drawings. However, it should be understood that the figures are not drawn to scale. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

For purposes of this disclosure, certain aspects, advantages, and novel features are described herein. It is to be understood that not necessarily all such advantages may be achieved in accordance with any particular embodiment.

Thus, for example, those skilled in the art will recognize that the disclosure may be embodied or carried out in a manner that achieves one advantage or a group of advantages as taught herein without necessarily achieving other advantages as may be taught or suggested herein.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Further, the actions of the disclosed processes and methods may be modified in any manner, including by reordering actions and/or inserting additional actions and/or deleting actions. Thus, it is intended that the scope of at least some of the present inventions herein disclosed should not be limited by the particular disclosed embodiments described above. The limitations in the claims are to be interpreted broadly based on the language employed in the claims and not limited to the examples described in the present specification or during the prosecution of the application, which examples are to be construed as non-exclusive.

What is claimed is:

1. An awning joint, comprising:

an arm coupler;

a supporting seat configured to mount to a wall support;

a first mechanism comprising an adjustment member coupled with the supporting seat and comprising a lower periphery from which a projection extends, the first mechanism further comprising a threaded actuator for adjusting an orientation of the adjustment member to adjust the orientation of the projection from a first position corresponding to a first extended orientation of the arm coupler to a second position corresponding to a second extended orientation of the arm coupler, the second extended orientation being at a higher angle from horizontal than the first extended orientation, the threaded actuator coupled with the adjustment member at a location spaced apart from the projection; and a second mechanism comprising a U-shaped flange disposed around the adjustment member, the U-shaped flange comprises a downward facing bight configured to engage the projection when the arm coupler is in the second extended orientation, the downward facing bight sized to fit over an upward facing surface of the projection, wherein the downward facing bight is pivotable relative to the projection such that in a first configuration a gap is provided between the downward facing bight and the upward facing surface of the projection, the U-shaped flange pivotably coupled with an axle and responsive to a vertical force that raises the arm coupler toward an angle corresponding to the first extended orientation without actuating the threaded actuator of the first mechanism.

2. The awning joint of claim 1, wherein the first mechanism is pivotably coupled with the supporting seat about a horizontal axis, the threaded actuator being rotatable about a vertical axis.

3. The awning joint of claim 1, wherein the adjustment member comprises a U-shaped configuration configured to nest within the U-shaped flange of the second mechanism.

4. The awning joint of claim 3, wherein the U-shaped flange comprises a first end pivotally mounted to a first end of the adjustment member and a second end pivotally mounted to a second end of the adjustment member.

5. The awning joint of claim 1, wherein the U-shaped flange of the second mechanism is coupled with a cylindrical member, the arm coupler being coupled with the cylindrical member for rotation about an axis extending through the cylindrical member such that the arm coupler can rotate away from the supporting seat in an extended configuration and can rotate toward the supporting seat to be positioned in a retracted configuration.

6. The awning joint of claim 1, further comprising a limiter rotatable with the arm coupler such that the limiter extends under the adjustment member when the arm coupler is rotated outward to an extended position, the adjustment member overlapping a portion of the limiter to limit upward movement of the second mechanism and of the arm coupler.

7. The awning joint of claim 6, wherein the arm coupler comprises a fork portion disposed around a cylindrical portion of the second mechanism, the cylindrical portion coupled with the U-shaped flange, the limiter being disposed between the cylindrical portion and the fork portion of the arm coupler.

8. The awning joint of claim 6, wherein the limiter comprises an asymmetrical plate with a first edge disposed a first distance from a center of rotation of the asymmetrical plate and a second edge disposed a second distance from the center of rotation of the asymmetrical plate, the second distance less than the first distance, the first edge configured to be disposed under the adjustment member when the arm coupler is in the second extended orientation, the second edge configured to be positioned lateral of the adjustment member when the arm coupler is disposed in a retracted configuration.

9. An awning joint, comprising:

a supporting seat, an adjustment member, a retraction joint, and an arm coupler;

wherein the arm coupler is attached with the retraction joint and movable between an extended configuration and a retracted configuration, the retraction joint is pivotably coupled with the adjustment member at a horizontal rotation axis, and the adjustment member is coupled with the supporting seat by a supporting shaft oriented in a horizontal direction;

wherein a threaded actuator coupled with a slider shaft that is disposed in a slot of the adjustment member is configured to raise and lower the slider shaft relative to the supporting seat between two vertically spaced apart elevations to move the slider shaft within the slot to provide movement of the adjustment member to adjust an angle of the adjustment member about the supporting shaft, the angle of the adjustment member determining an angle of extension of the arm coupler in the extended configuration of the arm coupler, the retraction joint being pivotabe due to a vertical force to raise the arm coupler toward a horizontal position independently of the threaded actuator.

10. The awning joint of claim 9, wherein the adjustment member permits an extendible arm connected with the arm coupler to be angled downward from a horizontal plane in the extended configuration and the retraction joint permits the extendible arm connected with the arm coupler to be angled horizontally in the retracted configuration.

11. The awning joint of claim 9, wherein the adjustment member comprises a U-shaped configuration with a first end in which the slot is disposed and through which the slider shaft is disposed and a second end opposite the first end, the second end comprising a projection configured to extend under and support the retraction joint in an extended configuration to define an angle of the arm coupler in the extended configuration.

12. The awning joint of claim 11, wherein the retraction joint comprises a U-shaped flange disposed around the adjustment member, the U-shaped flange comprising a downward facing bight configured to receive the projection when the arm coupler is in the extended configuration.

* * * * *